US012410022B2

(12) United States Patent
Ishida

(10) Patent No.: US 12,410,022 B2
(45) Date of Patent: Sep. 9, 2025

(54) SHEET STORAGE DEVICE AND IMAGE FORMING APPARATUS INCLUDING SAME

(71) Applicant: KYOCERA Document Solutions Inc., Osaka (JP)

(72) Inventor: Hirotaka Ishida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/753,178

(22) Filed: Jun. 25, 2024

(65) Prior Publication Data

US 2025/0002277 A1 Jan. 2, 2025

(30) Foreign Application Priority Data

Jun. 28, 2023 (JP) ..... 2023-105983

(51) Int. Cl.
*B65H 1/14* (2006.01)
*B65H 1/04* (2006.01)

(52) U.S. Cl.
CPC ..... *B65H 1/14* (2013.01); *B65H 1/04* (2013.01); *B65H 2403/40* (2013.01); *B65H 2403/722* (2013.01); *B65H 2405/1117* (2013.01)

(58) Field of Classification Search
CPC ... B65H 1/14; B65H 1/18; B65H 1/20; B65H 2403/40; B65H 1/24; B65H 1/04; B65H 2403/722; B65H 2405/1117; B65H 1/10; B65H 1/12; B65H 1/16
See application file for complete search history.

(56) References Cited

U.S. PATENT DOCUMENTS 8,540,234 B2 * 9/2013 Akatsuka ..... B65H 3/0669 271/147

FOREIGN PATENT DOCUMENTS

JP 8-217266 A 8/1996

* cited by examiner

*Primary Examiner* — Jeremy R Severson
(74) *Attorney, Agent, or Firm* — Stein IP, LLC

(57) ABSTRACT

A sheet storage device includes a lift plate, a push-up member, a first gear, a second gear which meshes with the first gear, a transmission mechanism which includes a third gear that meshes with the second gear and a turning restriction member. The first gear includes a support portion. The turning restriction member includes: an annular portion which is slidable on the outer circumferential surface of the support portion in a direction of rotation; and a protrusion portion which protrudes outward in a radial direction from the annular portion to be able to engage with the second gear. The protrusion portion has a shape such that the protrusion portion cannot pass through a gap between the second gear and the annular portion and is located, relative to the gap, on a downstream side in a direction of rotation of the second gear caused by the power of a motor.

6 Claims, 8 Drawing Sheets

SHEET STORAGE DEVICE AND IMAGE FORMING APPARATUS INCLUDING SAME

INCORPORATION BY REFERENCE

This application is based upon and claims the benefit of priority from the corresponding Japanese Patent Application No. 2023-105983 (filed on Jun. 28, 2023), the entire contents of which are incorporated herein by reference.

BACKGROUND

The present disclosure relates to a sheet storage device and an image forming apparatus which includes such a sheet storage device.

A conventional sheet storage device includes a lift plate which can be raised and lowered. Sheets are placed on the lift plate. The lift plate is raised to hold the height position of the uppermost sheet on the lift plate in a predetermined position.

The conventional sheet storage device includes a paper feed roller which makes contact with the sheet in the predetermined position from above. The paper feed roller is rotated in a state where the paper feed roller is in contact with the sheet to feed the sheet. When the uppermost sheet on the lift plate is not in the predetermined position, the paper feed roller idles so as not to feed the sheet.

SUMMARY

A sheet storage device according to a first aspect of the present disclosure includes a lift plate, a push-up member, a first gear, a second gear, a transmission mechanism and a turning restriction member. A sheet is placed on the lift plate. The push-up member is turnably supported below the lift plate, receives transmission of the power of a motor and is turned in a lift-up direction to push up the lift plate. The first gear is rotated in one direction by the power of the motor. The second gear meshes with the first gear. The transmission mechanism includes at least a third gear which meshes with the second gear to transmit the power of the motor to the push-up member. The turning restriction member restricts turning of the push-up member in a direction opposite to the lift-up direction. The first gear includes a cylindrical support portion with the center axis of the first gear being a cylindrical axis. The turning restriction member includes an annular portion and a protrusion portion. The support portion is fitted to the annular portion, and the annular portion is slidable on the outer circumferential surface of the support portion in the direction of the rotation. The protrusion portion protrudes outward in a radial direction from the annular portion to be able to engage with the second gear. The protrusion portion has a shape such that the protrusion portion cannot pass through a gap between the second gear and the annular portion in a direction orthogonal to an axial direction, and is located, relative to the gap, on a downstream side in a direction of rotation of the second gear caused by the power of the motor.

An image forming apparatus according to a second aspect of the present disclosure includes the sheet storage device described above, and conveys the sheet and prints an image on the sheet.

DETAILED DESCRIPTION

A sheet storage device 100 according to an embodiment of the present disclosure and an image forming apparatus 1000 which includes the sheet storage device 100 will be described below with reference to FIGS. 1 to 8. The image forming apparatus 1000 is installed on a floor surface. A direction perpendicular to the floor surface (flat surface) on which the image forming apparatus 1000 is installed corresponds to an up/down direction.

<Configuration of Image Forming Apparatus>

The image forming apparatus 1000 of the present embodiment is a printer. The image forming apparatus 1000 can perform a print job. The image forming apparatus 1000 performs the print job to print an image on a sheet S. The printing system of the image forming apparatus 1000 is, for example, an electrophotographic system. The printing system of the image forming apparatus 1000 may be an inkjet system.

Figure 1:
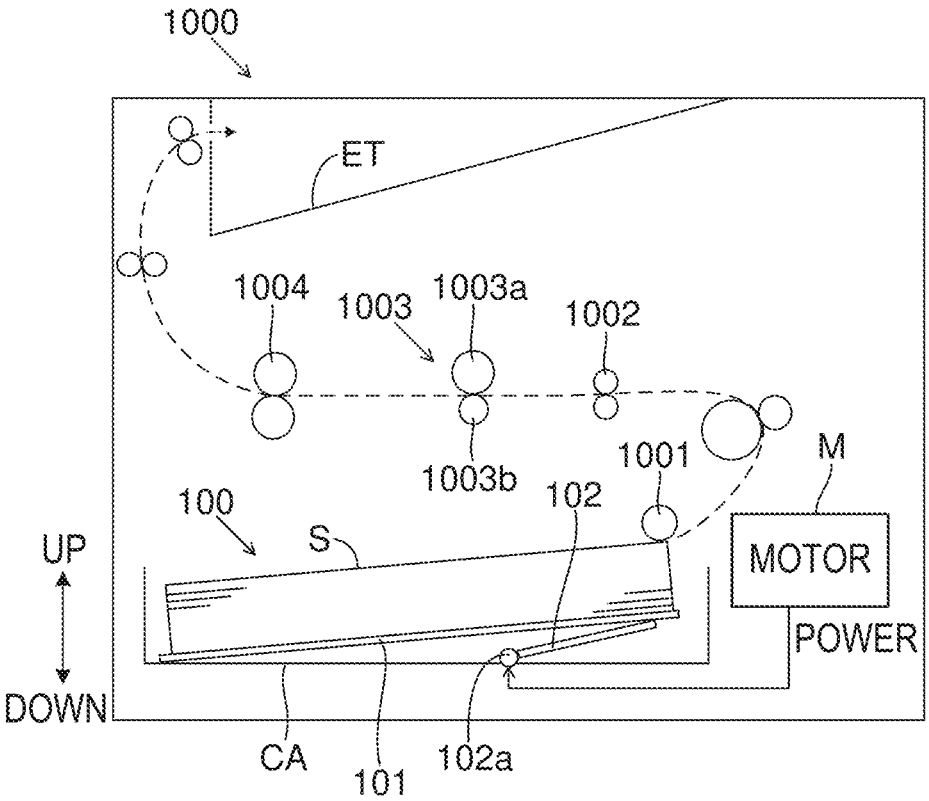
FIG. 1 is a schematic view of an image forming apparatus which includes a sheet storage device according to an embodiment.

The image forming apparatus 1000 includes the sheet storage device 100. The sheet storage device 100 stores the sheet S which is used in the print job. For example, the sheet S is a sheet (that is, made of paper). The image forming apparatus 1000 conveys the sheet S stored in the sheet storage device 100 along a conveyance path, and prints an image on the sheet S being conveyed. In FIG. 1, the conveyance path for the sheet S is schematically indicated by a dotted line with an arrow. A direction indicated by the arrow is a sheet conveyance direction.

Hereinafter, a direction which is orthogonal to the sheet conveyance direction and is also orthogonal to the up/down direction may be referred to as a width direction. In FIG. 1, a direction perpendicular to the plane of the sheet is the width direction. For example, FIG. 1 corresponds to a diagram when the image forming apparatus 1000 is viewed from the front. In other words, the width direction is also a forward/backward direction.

The image forming apparatus 1000 includes a paper feed roller 1001. The paper feed roller 1001 is supported to be rotatable around an axis extending in the width direction. The paper feed roller 1001 feeds the sheet S stored in the sheet storage device 100 to the conveyance path. The paper feed roller 1001 makes contacts with the sheet S stored in the sheet storage device 100 from above, and is rotated. In this way, the sheet S is fed from the sheet storage device 100 to the conveyance path.

The image forming apparatus 1000 includes a registration roller pair 1002. The registration roller pair 1002 is supported to be rotatable around an axis extending in the width direction. The registration roller pair 1002 includes a pair of rollers which are pressed against each other. The registration roller pair 1002 nips the sheet S fed from the paper feed roller 1001, and is rotated. In this way, the registration roller pair 1002 conveys the sheet S. One roller of the registration roller pair 1002 is a drive roller to which power is transmitted from a motor M and which is rotated, and the other is a driven roller which is rotated by following the one registration roller.

The image forming apparatus 1000 includes an image formation unit 1003. The image formation unit 1003 includes a photosensitive drum 1003*a* and a transfer roller 1003*b*. Each of the photosensitive drum 1003*a* and the transfer roller 1003*b* is supported to be rotatable around an axis extending in the width direction. The photosensitive drum 1003*a* and the transfer roller 1003*b* are pressed against each other. The photosensitive drum 1003*a* and the transfer roller 1003*b* nip the sheet S fed from the registration roller pair 1002, and are rotated. In this way, the image formation unit 1003 conveys the sheet S.

The image formation unit 1003 further includes a charging device, an exposure device and a development device though they are not shown in the figure. The charging device charges the circumferential surface of the photosensitive drum 1003*a*. The exposure device forms an electrostatic latent image on the circumferential surface of the photosensitive drum 1003*a*. The development device develops the electrostatic latent image on the circumferential surface of the photosensitive drum 1003*a* into a toner image. The photosensitive drum 1003*a* nips the sheet S between the transfer roller 1003*b* and itself, is rotated together with the transfer roller 1003*b* and thereby transfers the toner image to the sheet S.

The image forming apparatus 1000 includes a fixing roller pair 1004. The fixing roller pair 1004 is supported to be rotatable around an axis extending in the width direction. The fixing roller pair 1004 includes a heating roller and a pressure roller. The heating roller incorporates a heater. The pressure roller is pressed against the heating roller, and the fixing roller pair 1004 nips the sheet S fed from the image formation unit 1003 and is rotated. In other words, the fixing roller pair 1004 heats and pressurizes the sheet S. In this way, the fixing roller pair 1004 fixes, to the sheet S, the toner image transferred to the sheet S. Thereafter, the sheet S is ejected to an ejection tray ET.

<Configuration of Sheet Storage Device>

The sheet storage device 100 includes a sheet cassette CA. The sheet cassette CA stores the sheet S. The sheet cassette CA is removable relative to the main body of the image forming apparatus 1000. When the print job is performed, and thus no sheet S is in the sheet cassette CA, the sheet cassette CA is pulled out from the main body of the apparatus, the sheets S are stored in the sheet cassette CA and thereafter, the sheet cassette CA is returned into the main body of the apparatus.

The sheet storage device 100 includes a lift plate 101. The lift plate 101 is arranged in the sheet cassette CA. The sheet S is stored in the sheet cassette CA, and thus the sheet S is placed on the lift plate 101. The lift plate 101 is turnable around an axis extending in the width direction. The lift plate 101 is turned with an end portion on an upstream side in a sheet feeding direction used as a support point so as to vertically swing an end portion on a downstream side in the sheet feeding direction. In FIG. 1, a direction which extends from the left side of the figure toward the right side is the sheet feeding direction.

While the print job is being performed, the turning of the lift plate 101 in a direction in which the end portion on the downstream side in the sheet feeding direction is raised and the stop of the turning are repeated. In this way, the lift plate 101 maintains the contact of the paper feed roller 1001 with the uppermost sheet S on the lift plate 101. Even when the number of sheets S on the lift plate 101 is decreased, the lift plate 101 is raised, and thus a state where the sheet S can be fed from the sheet cassette CA to the conveyance path is maintained.

The sheet storage device 100 includes a push-up member 102. The push-up member 102 is arranged in the sheet cassette CA. The push-up member 102 is supported below the lift plate 101 so as to be turnable around an axis extending in the width direction. The push-up member 102 is turned with an end portion on the upstream side in the sheet feeding direction used as a support point so as to vertically swing an end portion on the downstream side in the sheet feeding direction. The push-up member 102 is turned in a lift-up direction to push up the lift plate 101. The push-up member 102 may be turned with the end portion on the downstream side in the sheet feeding direction used as the support point so as to vertically swing the end portion on the upstream side in the sheet feeding direction. Regardless of the direction of turning of the push-up member 102, the lift plate 101 can be pushed up by the push-up member 102.

The sheet storage device 100 receives the power of the motor M which rotates the registration roller pair 1002. The power of the motor M is transmitted to the push-up member 102, and thus the push-up member 102 is turned in the lift-up direction. However, the present disclosure is not limited to this configuration. The power of a dedicated lift-up motor (not shown) may be transmitted to the push-up member 102, and thus the push-up member 102 may be turned in the lift-up direction.

<Turning of Push-Up Member in Lift-Up Direction>

The sheet storage device 100 includes a gear train which transmits the power of the motor M to the turning shaft 102*a* of the push-up member 102. The gear train of the sheet storage device 100 will be described below with reference to FIGS. 2 to 4. Each of all the gears of the sheet storage device 100 is rotatable around an axis extending in the width direction. In other words, in all the gears of the sheet storage device 100, the width direction is an axial direction.

In the following description, the direction of rotation of each of the gears of the sheet storage device 100 is based on a case where the rotation is viewed from one side in the axial direction. In the following description, regarding the direction of rotation of each of the gears of the sheet storage device 100, a counterclockwise direction may be simply referred to as one direction, and a clockwise direction may be simply referred to as the other direction.

The sheet storage device 100 includes a first gear 1 made of resin. Specifically the sheet storage device 100 includes a cylindrical member 10 made of resin which integrally includes the first gear 1. The cylindrical member 10 (that is, the first gear 1) is supported to be rotatable around the axis of a shaft 10A extending in the width direction. The cylindrical member 10 is a stepped cylindrical member. The cylindrical member 10 includes a small diameter portion and a large diameter portion which has an outside diameter larger than the small diameter portion. The first gear 1 is provided on the outer circumferential surface of the small diameter portion in the cylindrical member 10.

The cylindrical member 10 includes the large diameter portion on the one side in the axial direction (that is, a cylindrical axis direction) relative to the small diameter portion in which the first gear 1 is provided. In other words, the first gear 1 includes, on the one side in the axial direction, the cylindrical portion (that is, the large diameter portion) which has an outside diameter larger than the first gear 1. Although details will be described later, the cylindrical portion on the one side in the axial direction included in the first gear 1 is a support portion 11.

The power of the motor M is transmitted to the first gear 1, and thus the first gear 1 is rotated in one direction. The first gear 1 is rotated in the one direction, and thus the push-up member 102 is turned in the lift-up direction.

The sheet storage device 100 includes a second gear 2 made of resin. The second gear 2 meshes with the first gear 1. For example, the second gear 2 has its rotational shaft below the rotational shaft of the first gear 1 (that is, the shaft 10A). The first gear 1 which has received the power of the motor M is rotated in the one direction, and thus the second gear 2 is rotated in the other direction.

The second gear 2 is a stepped gear. The second gear 2 is a two-stage gear. The second gear 2 includes, as an input side gear 21, a part which meshes with the first gear 1. The second gear 2 includes, as an output side gear 22, a part which meshes with a third gear 3. A cylindrical boss portion protrudes from the input side gear 21 toward the one side in the axial direction. The output side gear 22 is provided on the outer circumferential surface of the boss portion. In other words, the outside diameter of the input side gear 21 is larger than that of the output side gear 22.

The sheet storage device 100 includes a transmission mechanism (the symbol of which is omitted) which includes a plurality of gears. The transmission mechanism transmits the power of the motor M to the turning shaft 102*a* of the push-up member 102 to turn the push-up member 102 in the lift-up direction. The transmission mechanism includes at least the third gear 3 made of resin which meshes with the second gear 2. The third gear 3 meshes with the output side gear 22. The second gear 2 is rotated in the other direction, and thus the third gear 3 is rotated in the one direction.

The transmission mechanism individually includes a fourth gear 4 and a fifth gear 5 which are made of resin. The fourth gear 4 meshes with the third gear 3. The third gear 3 is rotated in the one direction, and thus the fourth gear 4 is rotated in the other direction. The fifth gear 5 meshes with the fourth gear 4. The fourth gear 4 is rotated in the other direction, and thus the fifth gear 5 is rotated in the one direction. The number of gears in the transmission mechanism is not particularly limited.

The turning shaft 102*a* of the push-up member 102 is coupled to the fifth gear 5 via an unillustrated gear made of resin. In this way, the power of the motor M is transmitted to the turning shaft 102*a* of the push-up member 102. The power of the motor M is transmitted to the push-up member 102, and thus the push-up member 102 is turned in the lift-up direction to push up the lift plate 101.

The sheet storage device 100 includes a switching mechanism 7. The switching mechanism 7 switches between the transmission of the power from the motor M to the first gear 1 and the blocking of the transmission. The power is transmitted from the motor M to the first gear 1, and thus the first gear 1 is rotated in the one direction. When the transmission of the power from the motor M to the first gear 1 is blocked, the first gear 1 is not rotated in the one direction. When the first gear 1 is not rotated in the one direction, the push-up member 102 is not turned in the lift-up direction, and thus the lift plate 101 is not raised.

The configuration of the switching mechanism 7 is not particularly limited. It is sufficient that it is possible to switch between the transmission of the power from the motor M to the first gear 1 and the blocking of the transmission. For example, the switching mechanism 7 includes a planetary gear mechanism. The configuration of the switching mechanism 7 will be described below. The configuration of the switching mechanism 7 which will be described below is an example. As the switching mechanism 7, a mechanism which includes an electromagnetic clutch can also be used.

The switching mechanism 7 includes the planetary gear mechanism which is coupled to the first gear 1. Specifically, the switching mechanism 7 includes an internal gear 71. The internal gear 71 is supported to be rotatable around the axis of the shaft 10A. The internal gear 71 is provided on the inner circumferential surface of the large diameter portion in the cylindrical member 10 which includes the first gear 1. In other words, the cylindrical member 10 integrally includes the internal gear 71. Since the internal gear 71 is formed of the same material as the cylindrical member 10, the internal gear 71 is made of resin.

The switching mechanism 7 includes a sun gear 72 made of resin. The sun gear 72 is supported to be rotatable around the axis of the shaft 10A. The sun gear 72 is arranged inside the internal gear 71 (that is, inside the large diameter portion of the cylindrical member 10).

The switching mechanism 7 includes a plurality of planetary gears 73 which are made of resin. Inside the internal gear 71 (that is, inside the large diameter portion of the cylindrical member 10), the planetary gears 73 are arranged to surround the sun gear 72. The planetary gears 73 mesh with the sun gear 72, and also mesh with the internal gear 71.

The switching mechanism 7 includes a planetary carrier 74 made of resin. The planetary carrier 74 is supported to be rotatable around the axis of the shaft 10A. The planetary carrier 74 rotatably supports the planetary gears 73. In this way, the planetary gears 73 can revolve while rotating around the sun gear 72. The planetary gears 73 revolve around the sun gear 72, and thus the planetary carrier 74 is rotated.

The planetary carrier 74 integrally includes a power input gear 730. The power input gear 730 is supported to be rotatable around the axis of the shaft 10A. The power input gear 730 is arranged on the one side in the axial direction relative to the cylindrical member 10 (the large diameter portion thereof). Although a part of the planetary carrier 74 which supports the planetary gears 73 is arranged inside the cylindrical member 10, a part of the planetary carrier 74 which includes the power input gear 730 is arranged outside the cylindrical member 10. Since the power input gear 730 is formed of the same material as the planetary carrier 74, the power input gear 730 is made of resin.

Figure 2:
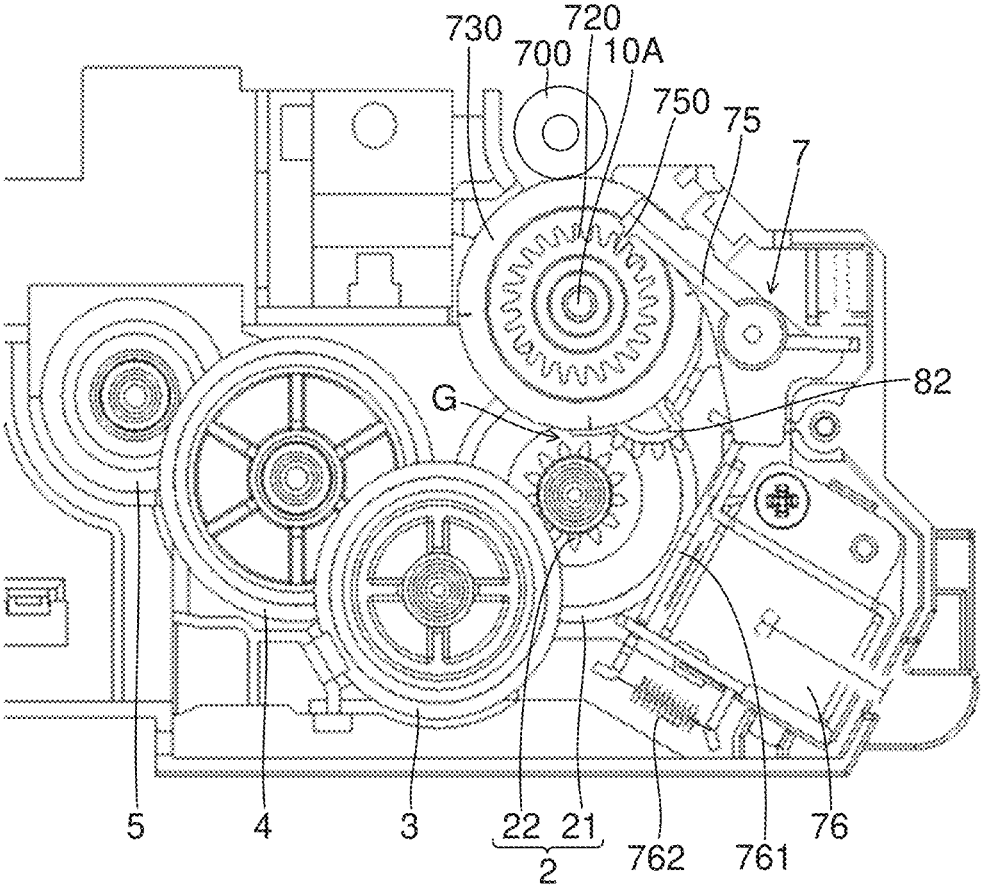
FIG. 2 is a plan view when a gear train coupled to a push-up member in the sheet storage device according to the embodiment is viewed in an axial direction.
Figure 3:
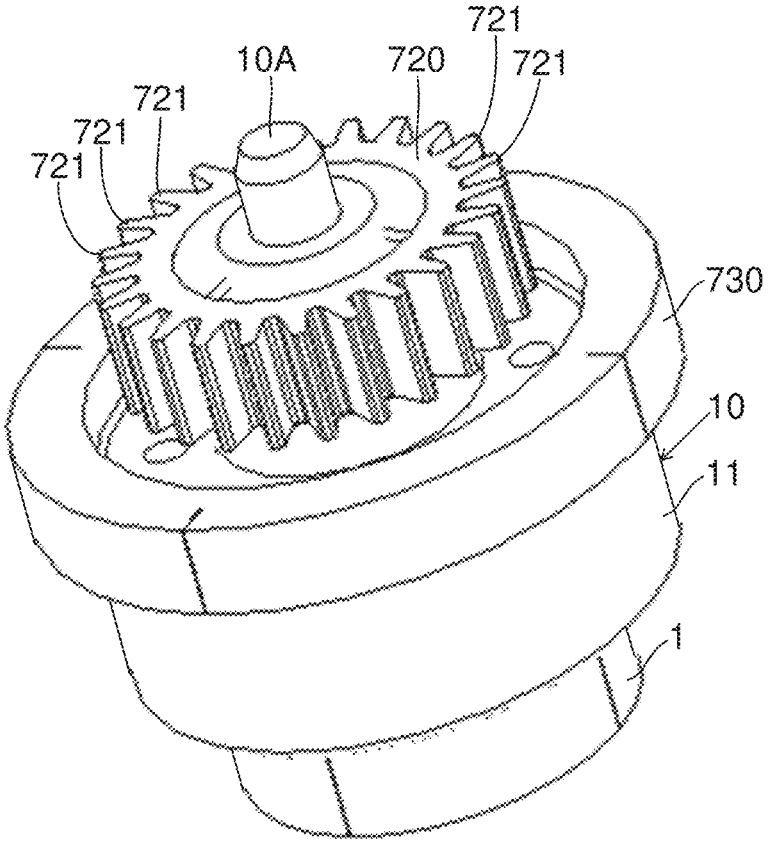
FIG. 3 is a perspective view of a first gear and an area therearound in the sheet storage device according to the embodiment.
Figure 4:
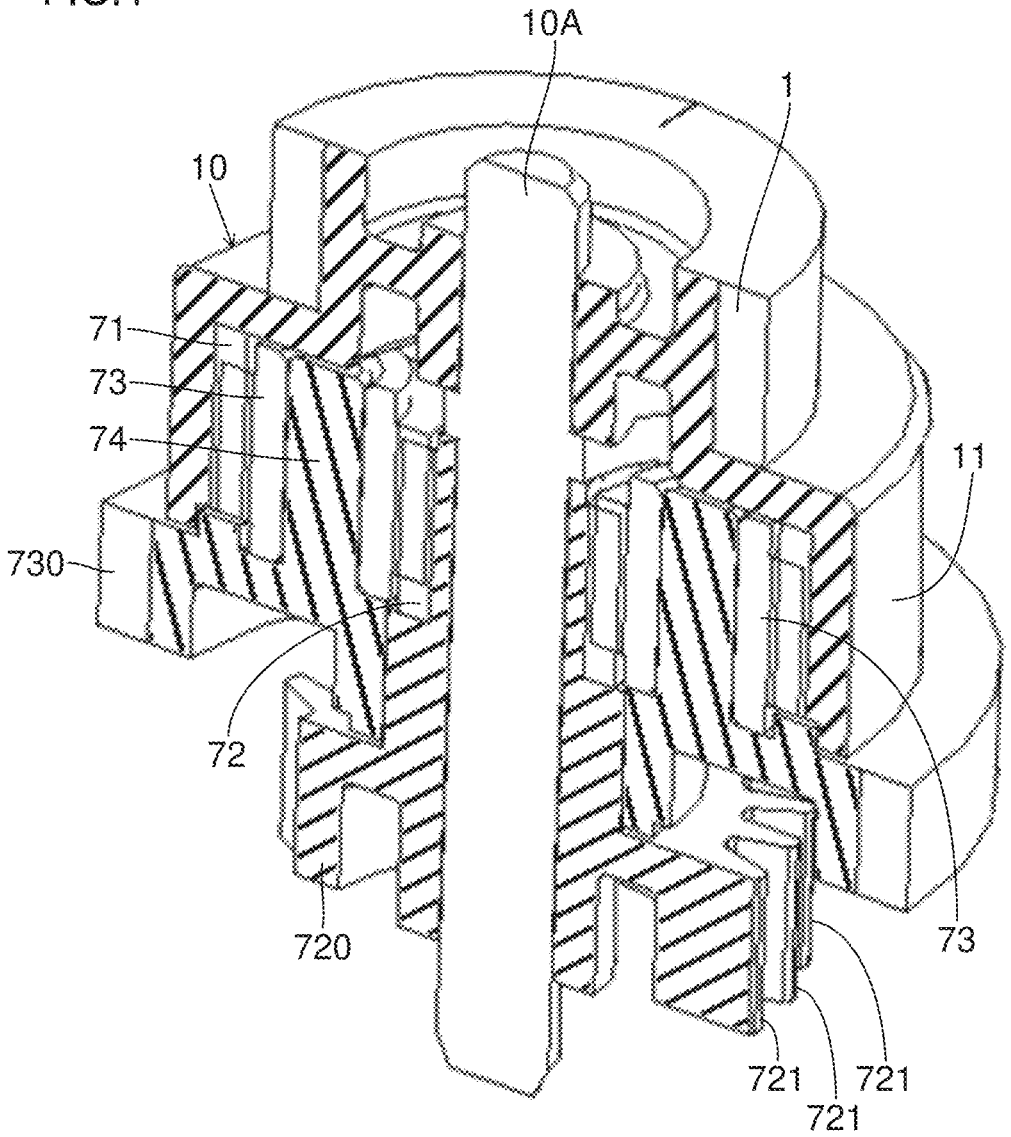
FIG. 4 is a cross-sectional perspective view of the first gear and the area therearound in the sheet storage device according to the embodiment.

The power input gear 730 meshes with a drive gear 700 (see FIG. 2). The drive gear 700 is a gear which is attached to the rotational shaft of the drive roller in the registration roller pair 1002, and is rotated together with the drive roller. In other words, the drive gear 700 is a gear on the most upstream side in a direction in which the power is transmitted from the motor M to the turning shaft 102*a* of the push-up member 102.

Here, the sun gear 72 integrally includes an engagement rotation member 720 which is rotatable around the axis of the shaft 10A. The engagement rotation member 720 is rotated together with the sun gear 72. Since the sun gear 72 is integral with the engagement rotation member 720, when the engagement rotation member 720 is in a state where the engagement rotation member 720 cannot be rotated, the sun gear 72 is not rotated.

The engagement rotation member 720 is arranged on the one side in the axial direction relative to the power input gear 730. The engagement rotation member 720 includes a boss portion which extends to the inside of the large diameter portion of the cylindrical member 10. The sun gear 72 is provided on the outer circumferential surface of the boss portion extending from the engagement rotation member 720. In this way, the sun gear 72 is arranged inside the large diameter portion of the cylindrical member 10 to mesh with the planetary gears 73. Since the engagement rotation member 720 is formed of the same material as the sun gear 72, the engagement rotation member 720 is made of resin.

The engagement rotation member 720 includes, on its outer circumferential surface, a plurality of protrusions 721 which protrude outward in its radial direction. The protrusions 721 are spaced in the direction of rotation of the engagement rotation member 720. In other words, the engagement rotation member 720 includes protrusions and recesses in the outer circumferential surface. Furthermore, in other words, the outer circumferential surface of the engagement rotation member 720 can engage with a claw member 75 which will be described later.

While the power input gear 730 is being rotated, the engagement rotation member 720 is brought into the state where the engagement rotation member 720 cannot be rotated (that is, a state where the sun gear 72 cannot be rotated), and thus the first gear 1 is rotated in the one direction. In other words, the power of the motor M is transmitted to the first gear 1, and thus the first gear 1 is rotated in the one direction. In this way, the second gear 2 is rotated in the other direction, the third gear 3 is rotated in the one direction and thus the push-up member 102 is turned in the lift-up direction. Consequently, the lift plate 101 is raised.

While the power input gear 730 is being rotated, the engagement rotation member 720 is brought into a state where the engagement rotation member 720 can be rotated (that is, a state where the sun gear 72 can be rotated), and thus the power of the motor M is not transmitted to the first gear 1. In other words, the transmission of the power from the motor M to the first gear 1 is blocked. In this way, the power for turning the push-up member 102 in the lift-up direction is not transmitted to the turning shaft 102*a* of the push-up member 102. Here, the rotation of the first gear 1 is not locked, and thus the first gear 1 is brought into a state where the first gear 1 can be rotated in the other direction opposite to the one direction.

In this configuration, when the lift plate 101 is desired to be raised (that is, when the push-up member 102 is desired to be turned in the lift-up direction), the engagement rotation member 720 is preferably brought into the state where the engagement rotation member 720 cannot be rotated. When the raising of the lift plate 101 is desired to be stopped (that is, when the turning of the push-up member 102 in the lift-up direction is desired to be stopped), the engagement rotation member 720 is preferably brought into the state where the engagement rotation member 720 can be rotated.

Hence, the switching mechanism 7 includes the claw member 75. The claw member 75 includes a claw 750 which can engage with the engagement rotation member 720 (the protrusions and recesses in the outer circumferential surface thereof). The claw member 75 is supported to be turnable in a direction approaching the engagement rotation member 720 and in a direction separating from the engagement rotation member 720.

The claw member 75 is turned in the direction approaching the engagement rotation member 720 to engage with the engagement rotation member 720. The claw 750 engages with any one of the protrusions 721, and thus the claw member 75 engages with the engagement rotation member 720. The claw member 75 is turned in the direction separating from the engagement rotation member 720, and thus the engagement of the engagement rotation member 720 with the claw member 75 is released.

The switching mechanism 7 also includes a solenoid 76. The solenoid 76 includes a movable member 761 and a tension coil spring 762. The movable member 761 is coupled to the claw member 75. The position of the movable member 761 is displaced, and thus the claw member 75 approaches the engagement rotation member 720 or the claw member 75 separates from the engagement rotation member 720. One end of the tension coil spring 762 is coupled to the movable member 761.

The solenoid 76 generates a magnetic force to displace the position of the movable member 761 against the tensile force of the tension coil spring 762, and thereby moves the claw member 75 in the direction approaching the engagement rotation member 720. In other words, the solenoid 76 generates the magnetic force to cause the claw member 75 to engage with the engagement rotation member 720.

On the other hand, when the claw member 75 is moved in the direction separating from the engagement rotation member 720, the solenoid 76 stops the generation of the magnetic force. In this way, by the tensile force of the tension coil spring 762, the claw member 75 is moved in the direction separating from the engagement rotation member 720. In other words, the engagement of the engagement rotation member 720 with the claw member 75 is released.

The claw member 75 engages with the engagement rotation member 720, and thus the engagement rotation member 720 cannot be rotated, with the result that the sun gear 72 cannot be rotated. In this way, the first gear 1 is rotated in the one direction (that is, in a direction which turns the push-up member 102 in the lift-up direction).

On the other hand, the engagement of the engagement rotation member 720 with the claw member 75 is released, and thus the engagement rotation member 720 can be rotated, with the result that the sun gear 72 can be rotated. In this way, the first gear 1 is not rotated in the one direction. In other words, the power of the motor M is not transmitted to the first gear 1. Here, the first gear 1 is brought into the state where the first gear 1 can be rotated in the other direction opposite to the one direction.

<Restriction of Turning of Push-Up Member in Direction Opposite to Lift-Up Direction>

Figure 5:
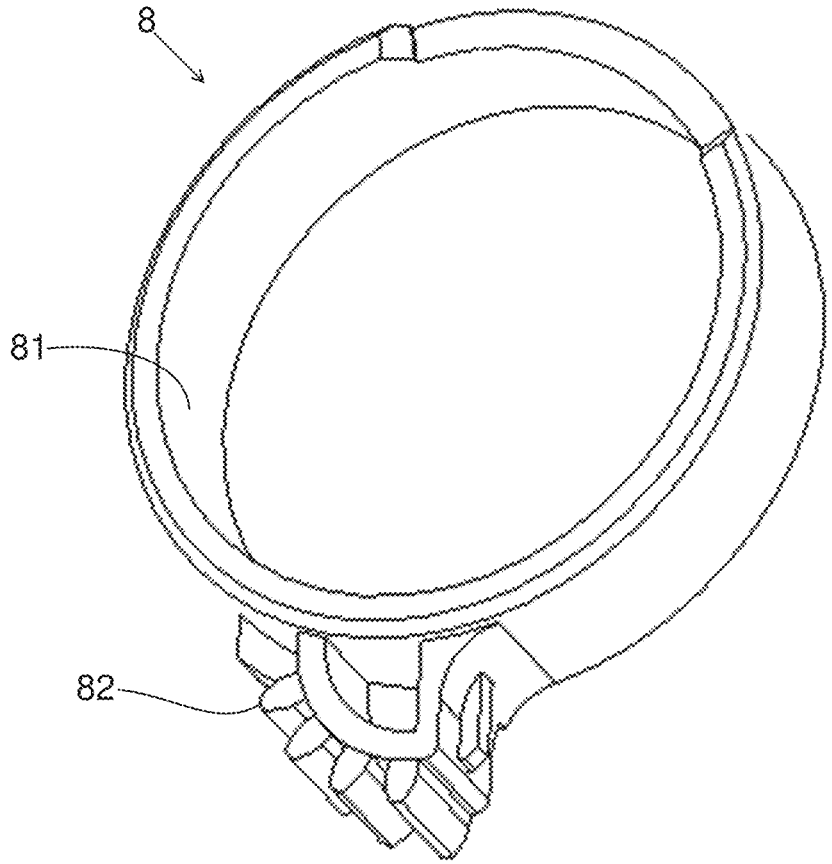
FIG. 5 is a perspective view of a turning restriction member in the sheet storage device according to the embodiment.
Figure 6:
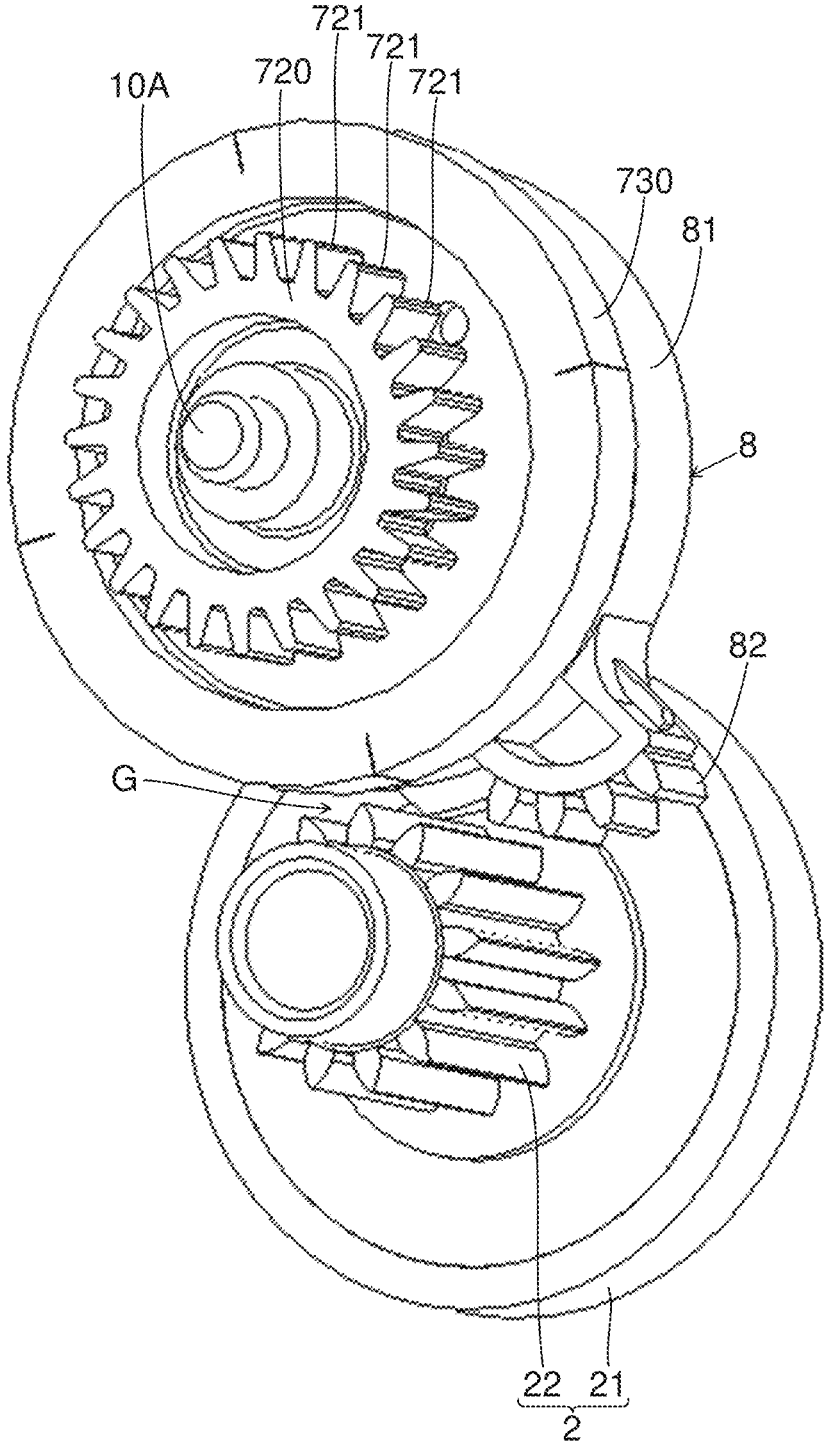
FIG. 6 is a perspective view of the turning restriction member and an area therearound in the sheet storage device according to the embodiment.

The sheet storage device 100 includes a turning restriction member 8 as shown in FIGS. 5 and 6. The turning restriction member 8 is made of resin. The turning restriction member 8 restricts the turning of the push-up member 102 in a direction opposite to the lift-up direction. The turning restriction member 8 is supported by the cylindrical member 10. The turning restriction member 8 restricts the rotation of the second gear 2 when the transmission of the power from the motor M to the first gear 1 is blocked so as to restrict the turning of the push-up member 102 in the direction opposite to the lift-up direction.

The turning restriction member 8 includes an annular portion 81. The annular portion 81 is annular when viewed in the axial direction (that is, the width direction). The inner edge of the annular portion 81 is circular when the annular portion 81 is viewed in the axial direction. The outer shape of the annular portion 81 when viewed in the axial direction is not particularly limited. For example, the annular portion 81 is annular when viewed in the axial direction.

The large diameter portion of the cylindrical member 10 is fitted to the annular portion 81, and thus the turning restriction member 8 is supported by the cylindrical member 10. In this configuration, the large diameter portion of the cylindrical member 10 serves as the support portion which supports the turning restriction member 8. In the following description, the large diameter portion of the cylindrical member 10 is identified with a symbol 11, and is referred to as the support portion 11 (see FIGS. 3 and 4).

The large diameter portion of the cylindrical member 10 is a part of the first gear 1. In other words, the first gear 1 includes the cylindrical support portion 11 with its center axis being a cylindrical axis. The first gear 1 includes the support portion 11 on the one side in the axial direction.

The turning restriction member 8 includes a protrusion portion 82 which protrudes outward in the radial direction from the annular portion 81. The "outward in the radial direction" indicates a direction from the inside of the annular portion 81 (that is, the annular member) toward the outside. The protrusion portion 82 includes a plurality of protrusions which can engage with the output side gear 22 of the second gear 2. The second gear 2 includes a cylindrical engagement portion which includes protrusions and recesses in the outer circumferential surface thereof with its center axis being a cylindrical axis. The output side gear 22 corresponds to the "engagement portion".

The turning restriction member 8 is rotatable around the axis of the first gear 1. Specifically, the annular portion 81 is slidable on the outer circumferential surface of the support portion 11 around the axis of the first gear 1. A lubricant such as grease may be arranged between the outer circumferential surface of the support portion 11 and the inner circumferential surface of the annular portion 81.

The annular portion 81 is spaced relative to the output side gear 22 (its tip end) in a direction orthogonal to the axial direction. In other words, when the output side gear 22 and the annular portion 81 are viewed in the axial direction, a gap G is provided therebetween. In this way, even when the annular portion 81 slides on the outer circumferential surface of the support portion 11 so as to rotate, the annular portion 81 does not interfere with the output side gear 22.

However, the protrusion portion 82 has a shape such that the protrusion portion 82 cannot pass through the gap G between the output side gear 22 and the annular portion 81 in the direction orthogonal to the axial direction. In this way, although the annular portion 81 slides on the outer circumferential surface of the support portion 11, and thus the turning restriction member 8 is rotated around the axis of the first gear 1, when protrusion portion 82 reaches the gap G, the rotation of the turning restriction member 8 is stopped.

Here, the protrusion portion 82 is located, relative to the gap G between the output side gear 22 and the annular portion 81, on the downstream side in the direction of rotation of the output side gear 22 caused by the power of the motor M. In this way, the turning restriction member 8 has the function of restricting the turning of the push-up member 102 in the direction opposite to the lift-up direction.

Figure 7:
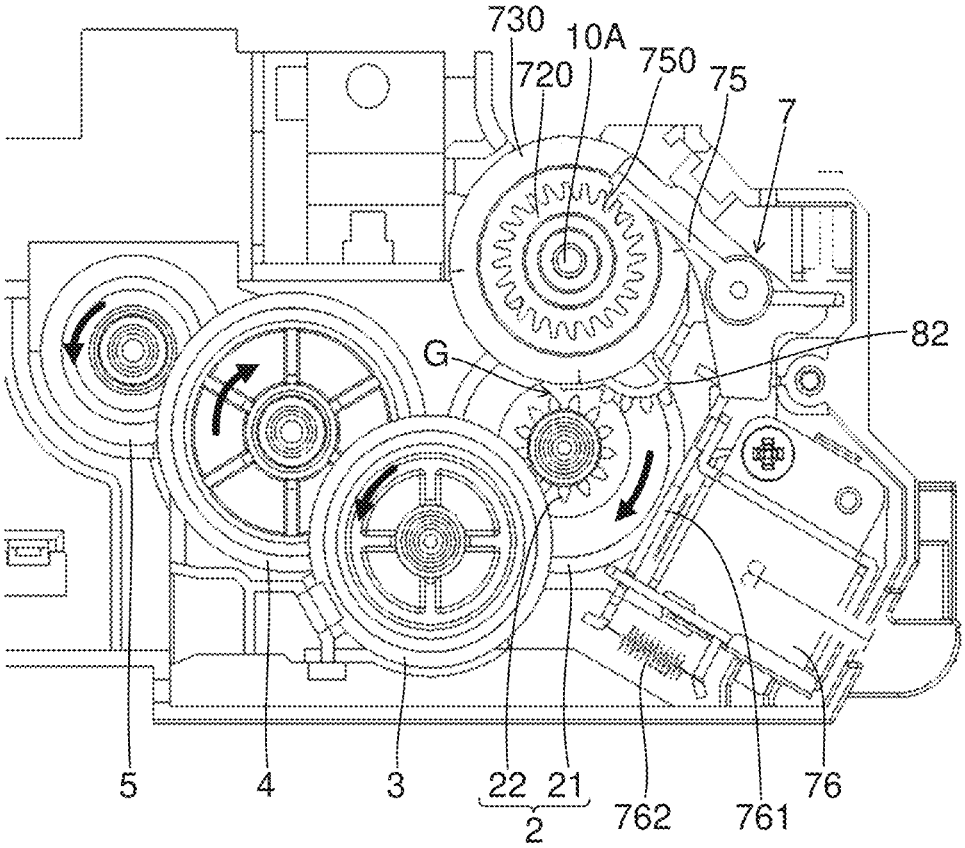
FIG. 7 is a diagram showing a state where a switching mechanism in the sheet storage device according to the embodiment transmits the power of a motor.
Figure 8:
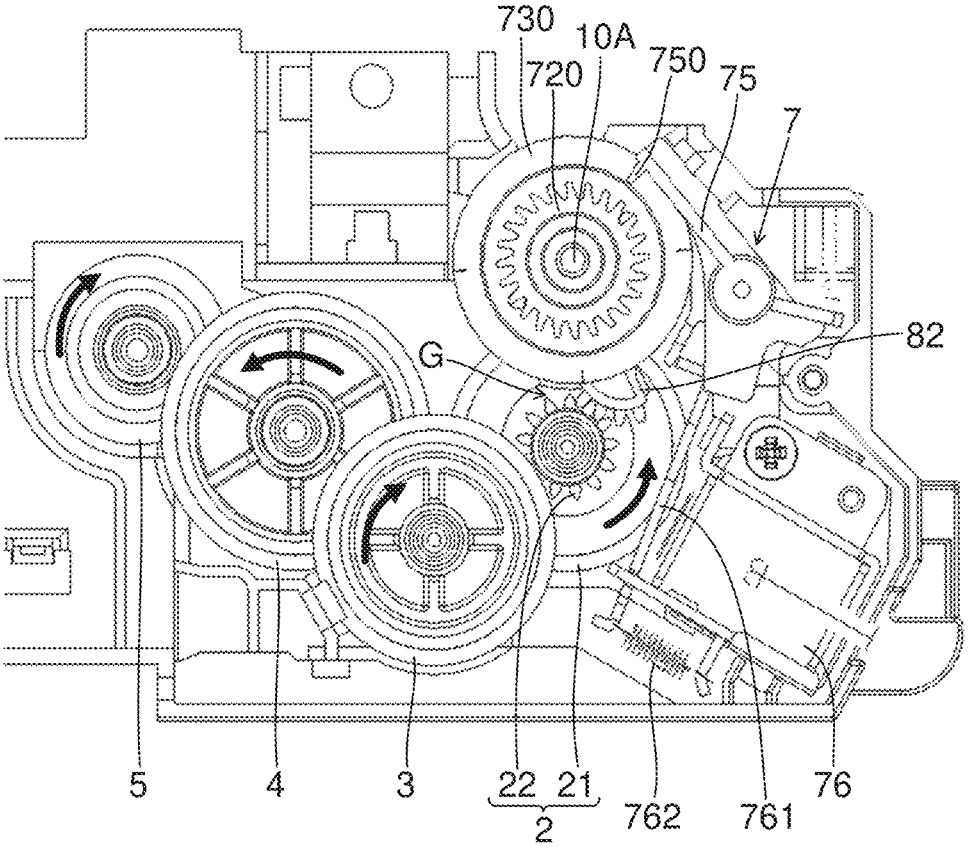
FIG. 8 is a diagram showing a state where the switching mechanism in the sheet storage device according to the embodiment blocks the transmission of the power of the motor.

A specific description will be given below with reference to FIGS. 7 and 8. In FIGS. 7 and 8, the directions of the rotation of the second to fifth gears 2 to 5 are indicated by bold arrows. In FIGS. 7 and 8, the first gear 1 is not shown.

When the power of the motor M is transmitted to the turning shaft 102*a* of the push-up member 102 to turn the push-up member 102 in the lift-up direction, as shown in FIG. 7, the claw member 75 engages with the engagement rotation member 720. Hence, the rotation of the engagement rotation member 720 is stopped.

Here, the first gear 1 is rotated in the one direction (counterclockwise direction). The second gear 2 is rotated in the other direction (clockwise direction). The third to fifth gears 3 to 5 are respectively rotated in the directions indicated by the corresponding arrows. In this way, the power of the motor M is transmitted to the turning shaft 102*a* of the push-up member 102, and thus the push-up member 102 is turned in the lift-up direction. The lift plate 101 is raised.

On the other hand, when the transmission of the power from the motor M to the turning shaft 102*a* of the push-up member 102 is blocked, as shown in FIG. 8, the engagement of the engagement rotation member 720 with the claw member 75 is released. Hence, the engagement rotation member 720 can be rotated.

Here, the rotation of the first gear 1 is stopped. Since the rotation of the first gear 1 is stopped, the rotation of the second gear 2 is also stopped. The rotation of the third to fifth gears 3 to 5 is also stopped. The engagement of the engagement rotation member 720 with the claw member 75 is released, and thus the first gear 1 can be rotated in the other direction.

Here, when the engagement of the engagement rotation member 720 with the claw member 75 is released, the push-up member 102 attempts to be turned in the direction opposite to the lift-up direction by the weight of the lift plate 101 and the weight of the sheet S on the lift plate 101. Here, the second to fifth gears 2 to 5 attempt to be rotated in the directions indicated by arrows in FIG. 8. The first gear 1 can be rotated in the other direction. Hence, when the second gear 2 attempts to be rotated in one direction (direction indicated by the arrow in FIG. 8), the first gear 1 attempts to be rotated in the other direction.

If the second gear 2 is rotated in the one direction, the lift plate 101 is lowered. Consequently, the paper feed roller 1001 is prevented from making contact with the sheet S on the lift plate 101, and thus a failure occurs in which the sheet S is not fed from the sheet storage device 100 to the conveyance path.

Hence, in the present embodiment, the turning restriction member 8 is arranged in the support portion 11 of the first gear 1. In this configuration, when the second gear 2 is rotated in the one direction (that is, when the second gear 2 is rotated in the direction opposite to the direction of rotation of the second gear 2 caused by the power of the motor M), the output side gear 22 engages with the protrusion portion 82 of the turning restriction member 8, and in this state, the turning restriction member 8 is rotated around the axis of the first gear 1 relative to the outer circumferential surface of the cylindrical member 10. Thereafter, although the protrusion portion 82 reaches the gap G between the output side gear 22 and the annular portion 81, the protrusion portion 82 cannot pass through the gap G. In other words, the protrusion portion 82 reaches the gap G, and thus the rotation of the turning restriction member 8 is stopped. Here, the output side gear 22 engages with the protrusion portion 82, and thus the second gear 2 is not rotated in the one direction any more. The second gear 2 is not rotated, and thus the third to fifth gears 3 to 5 are also not rotated.

In this way, in the present embodiment, it is possible to suppress the turning of the push-up member 102 in the direction opposite to the lift-up direction. In other words, it is possible to suppress the unintentional lowering of the lift plate 101 on which the sheet S is placed. Consequently, it is possible to suppress the occurrence of a failure in the feeding of the sheet S from the sheet storage device 100.

In the present embodiment, the turning restriction member 8 is formed with only the members shown in FIG. 5. In this way, it is possible to suppress the complication of the structure. For example, a worm wheel is arranged in a gear train, and thus it is possible to apply a brake to the first gear 1 using friction loss. However, when the worm wheel is arranged in the gear train, since the axial direction is changed, the number of components is increased, and the structure is complicated, with the result that this causes an increase in cost. Moreover, a drive loss when the push-up member 102 is turned in the lift-up direction is increased. On the other hand, the turning restriction member 8 is used, and thus it is possible to suppress the inconveniences described above.

In the present embodiment, the annular portion 81 is fitted to the support portion 11, and thus the turning restriction member 8 is supported. Here, the annular portion 81 is slidable on the outer circumferential surface of the support portion 11 in the direction of rotation thereof. In this configuration, when the first gear 1 is rotated in the one direction by the power of the motor M, by frictional resistance between the outer circumferential surface of the support portion 11 and the annular portion 81 and a force received from the second gear 2, the annular portion 81 displaces a rotational position in a direction in which the protrusion portion 82 is moved away from the gap G. The force received by the annular portion 81 from the second gear 2 is a force with which the output side gear 22 turns the protrusion portion 82. In this way, the rotation of the first gear 1 in the one direction is not prevented by the protrusion portion 82.

In the present embodiment, the output side gear 22 of the second gear 2 functions as the engagement portion which engages with the protrusion portion 82. In this way, an engagement portion which engages with the turning restriction member 8 does not need to be provided separately. The shape of the engagement portion which engages with the protrusion portion 82 is not particularly limited, and it is sufficient that the engagement portion can engage with the protrusion portion 82. In other words, the engagement portion does not need to be a gear.

It should be considered that the embodiment disclosed herein is illustrative in all respects and not restrictive. The scope of the present disclosure is indicated not by the description of the above embodiment but by the scope of claims, and furthermore, meanings equivalent to the scope of claims and all changes within the scope are included therein.

What is claimed is:

1. A sheet storage device comprising:
- a lift plate on which a sheet is placed;
- a push-up member
  - which is turnably supported below the lift plate,
  - to which power of a motor is transmitted and
  - which is turned in a lift-up direction to push up the lift plate;
- a first gear which is rotated in one direction by the power of the motor;
- a second gear which meshes with the first gear;
- a transmission mechanism which includes at least a third gear that meshes with the second gear to transmit the power of the motor to the push-up member; and
- a turning restriction member which restricts turning of the push-up member in a direction opposite to the lift-up direction,
- wherein the first gear includes a cylindrical support portion with a center axis of the first gear being a cylindrical axis,
- the turning restriction member includes
  - an annular portion to which the support portion is fitted and which is slidable on an outer circumferential surface of the support portion in the direction of the rotation and
  - a protrusion portion which protrudes outward in a radial direction from the annular portion to be able to engage with the second gear and
- the protrusion portion
  - has a shape such that the protrusion portion cannot pass through a gap between the second gear and the annular portion in a direction orthogonal to an axial direction and
  - is located, relative to the gap, on a downstream side in a direction of rotation of the second gear caused by the power of the motor.

2. The sheet storage device according to claim 1, further comprising:
- a switching mechanism which switches between transmission of the power from the motor to the first gear and blocking of the transmission,
- wherein when the transmission of the power from the motor is blocked, the first gear can be rotated in another direction opposite to the one direction.

3. The sheet storage device according to claim 2,
- wherein when the transmission of the power from the motor to the first gear is blocked such that the second gear is rotated in a direction opposite to the direction of the rotation of the second gear caused by the power of the motor, the turning restriction member is rotated in a state where the protrusion portion engages with the second gear, and stops the rotation thereof when the protrusion portion reaches the gap.

4. The sheet storage device according to claim 1,
- wherein when the first gear is rotated in the one direction, by frictional resistance between the outer circumferential surface of the support portion and the annular portion and a force received from the second gear, the annular portion displaces a rotational position in a direction in which the protrusion portion is moved away from the gap.

5. The sheet storage device according to claim 1,
- wherein the second gear
  - is a stepped gear and
  - includes an input side gear which meshes with the first gear and an output side gear which meshes with the third gear, and
- the protrusion portion can engage with the output side gear.

6. An image forming apparatus comprising:
- the sheet storage device according to claim 1,
- wherein the image forming apparatus conveys the sheet and prints an image on the sheet.

* * * * *